US005135763A

United States Patent [19]

Gillam et al.

[11] Patent Number: 5,135,763

[45] Date of Patent: Aug. 4, 1992

[54] METHOD AND APPARATUS FOR PROCESSING FOOD PRODUCTS

[75] Inventors: Kenneth E. Gillam, Azle; Robert L. Campbell, Fort Worth, both of Tex.

[73] Assignee: American Food Service Corporation, King of Prussia, Pa.

[21] Appl. No.: 654,933

[22] Filed: Feb. 13, 1991

[51] Int. Cl.[5] ..... B65B 57/00; G01N 33/00

[52] U.S. Cl. ..... 426/231; 53/66; 53/389.3; 426/414; 426/420

[58] Field of Search ..... 426/231, 414, 420; 53/66, 389.3; 83/371, 365, 586, 607

[56] References Cited

U.S. PATENT DOCUMENTS 2,760,871 8/1956 Hensgen et al. ..... 426/420

3,448,696 6/1969 Verhoeven ..... 53/66

*Primary Examiner*—George Yeung

*Attorney, Agent, or Firm*—Kenneth C. Hill

[57] ABSTRACT

A system for stacking food products on cut sheets of paper provides several continuously moving conveyors. Products, such as meat patties, are placed onto continuous sheets of paper suitable for separating them in stacks. The weight of the products pressing the paper against the conveyor simply pulls the paper off of supply rolls at the rate of movement of the conveyor. A sensor detects the position of the food products on the conveyor, causing cutting blades to descend and cut the paper between the food products. Such cutting is performed without stopping the conveyors.

17 Claims, 3 Drawing Sheets

METHOD AND APPARATUS FOR PROCESSING FOOD PRODUCTS

BACKGROUND OF THE INVENTION

1. Field of the Invention

The present invention relates generally to food processing machinery, and more specifically to a system for placing food products such as meat patties onto papers suitable for separating patties in a stack.

2. Description of the Prior Art

Automation generally has made large inroads into the food preparation and processing industry. Automating as much as possible of the material handling and packaging of food products decreases costs and improves product consistency.

One part of the industry in which product handling can be automated is in the separation of meat patties and similar products with thin sheets of waxed paper or other material. For example, in packaging a plurality of meat patties in a stack, placing individual sheets of a material such as waxed paper between each patty prevents the meat from sticking together. This is desirable for patties which are frozen as well as those which are simply refrigerated. Preformed meat patties separated by thin sheets of paper are used in large numbers by the fast food hamburger industry.

Many different systems have been designed and built to perform this function. For example, U. S. Pat. No. 3,388,529 describes a machine for shaping meat patties and stacking them with cut sheets of paper between each item. The mechanism for stacking the patties on paper is included as part of the mechanism for forming the patties.

U. S. Pat. Nos. 3,461,483 and 3,675,387 describe systems for placing preformed meat patties onto a square of paper. Both of these patents describe embodiments in which paper is provided on a continuous roll, and cut into squares prior to the patty being placed on them. Since the square can be cut individually from a roll as needed, it is not necessary to provide large stacks of more expensive pre-cut paper.

U. S. Pat. No. 3,783,577 shows a different approach, in which a block having a number of pre-cut square patties is placed onto a sheet of flexible material before it is cut from the roll. The material is a plastic material which can be cut using a hot wire. A controller is used to play out the plastic material at a speed slower than a conveyor carrying the rectangular block of patties and the plastic material so that it remains under tension. When the block of patties reaches a cutting point, the conveyors are stopped and the plastic cut by passing a hot wire through it. The conveyor is then restarted and the block of patties is transported to the next processing station.

There are a number of drawbacks to using the prior art systems described above. Systems which use pre-cut paper sheets require a relatively complex handling mechanism for separating the sheets. In addition, the material cost for the pre-cut paper is relatively high. Several of the references describe systems in which paper squares are cut from a roll immediately prior to use. This has a lower material cost, but the relatively complex mechanism required for cutting and handling the square sheets of paper is fairly expensive and requires a fairly complex maintenance procedure. The '577 patent describes a system in which the meat patties are placed on the material prior to its being cut, which simplifies the system. However, a relatively complex control system is required to start and stop the conveyors for cutting, and to pay out the material off of the supply roll at a rate which is slower than the movement rate of the conveyor belt.

It would be desirable to provide a system for handling food products such as meat patties which is much simpler and less expensive than currently available designs. It would be further desirable for such a system be able to take advantage of the cheaper material costs of uncut paper.

SUMMARY OF THE INVENTION

3 It is therefore an object of the present invention to provide a system for handling food products such as meat patties.

It another object of the present invention to provide a system in which the products are placed onto sheets of paper suitable for stacking.

It is a further object of the present invention to provide such a system which is simple and inexpensive to build and maintain, and which uses inexpensive rolled paper.

Therefore, in accordance with the present invention, a system for stacking food products on cut sheets of paper provides several continuously moving conveyors. Products, such as meat patties, are placed onto continuous sheets of paper suitable for separating them in stacks. The weight of the products pressing the paper against the conveyor simply pulls the paper off of supply rolls at the rate of movement of the conveyor. A sensor detects the position of the food products on the conveyor, causing cutting blades to descend and cut the paper between the food products. Such cutting is performed without stopping the conveyors.

BRIEF DESCRIPTION OF THE DRAWINGS

The novel features believed characteristic of the invention are set forth in the appended claims. The invention itself however, as well as a preferred mode of use, and further objects and advantages thereof, will best be understood by reference to the following detailed description of an illustrative embodiment when read in conjunction with the accompanying drawings, wherein:

DESCRIPTION OF THE PREFERRED EMBODIMENT

Figure 1:
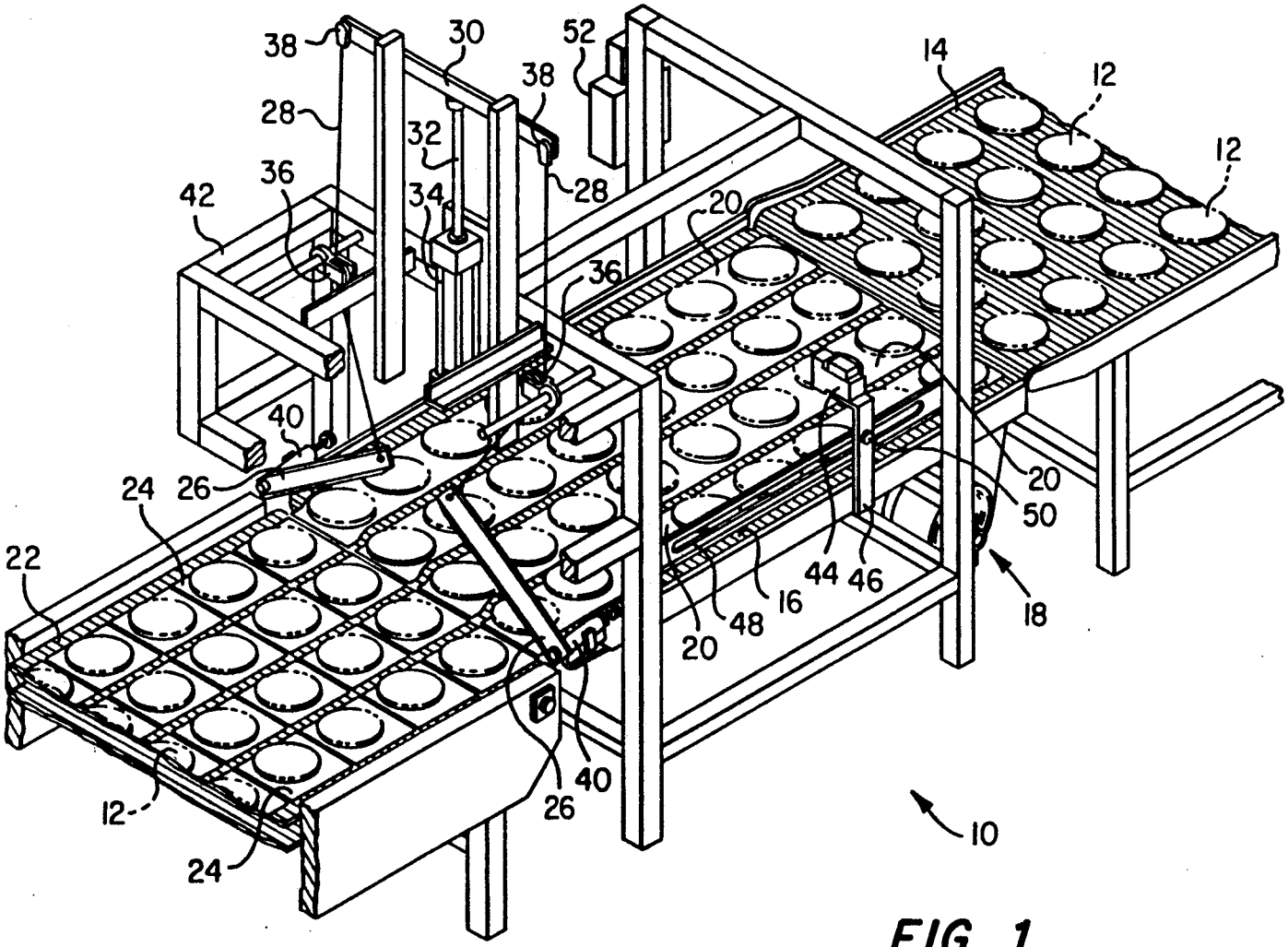
FIG. 1 is a perspective, partially cut away view of a system for handling food products according to the present invention.

Referring to FIG. 1, a system for handling food products such as meat patties is designated generally by the reference number 10. Preformed meat patties 12, or similar food products, are placed onto a moving conveyor 14 by a patty forming machine (not shown). Such patty forming machines are known in the art, and typically stamp four or more patties at a time out of various molds. The shape and thickness of the patties can be varied as desired in order to suit the requirements of the purchaser of the product.

As shown in FIG. 1, the patties 12 are conveyed from the upper right to the lower left corners of the drawing.

A second conveyor 16 also moves continuously, and is located within approximately ¼ inch of the end of conveyor 14. Paper rolls 18 are provided underneath conveyor 16. Uncut paper strips 20 are pulled off of the rolls 18 by the passage thereover of the patties 12. The weight of the patties 12 on the conveyor 16 causes the paper strips 20 to unroll. No drive mechanism is required for the rolls 18, which are simply free wheeling. The rolls 18 are aligned with the columns of patties 12 which are traveling along the conveyor 14.

FIG. 1 shows the use of four separate paper rolls 18, each roll having a width approximately the same as the size of one meat patty 12. As is described below, this results in each patty being individually placed onto its own cut sheet of paper. If it is desirable to place more than one patty on a single sheet of paper, wider rolls can be provided.

The patties on the uncut paper strips 20 are transported toward a third conveyor 22. Conveyor 22 is also continuously moving toward the lower left, and carries away patties 12 after the paper strips 20 have been separated into individual cut sheets 24. Cutting of the paper strips 20 is performed by cutting blades 26, which periodically drop down and cut the paper strips 20. The cutting blades 26 are lowered and raised quickly, so that the continuous movement of paper and patties on the upstream side of the blades is not impeded.

One end of each cutting blade 26 is connected to a cable 28. Both cables 28 are connected to a cross arm 30. The center of cross arm 30 is connected to piston rod 32 of air-powered cylinder 34.

Cables 28 are guided through pulleys 36, with the cables being approximately vertical between attachment points 38 and the pulleys 36. When cylinder 34 drives the piston rod 32 to an upper position, the cutting blades 26 are pulled into the up position shown in FIG. 1. When cylinder 34 drives the piston rod 32 down, the cutting blades 26 are allowed to fall and cut the paper strips 20.

One end of each blade 26 is rotatably affixed to a spring mechanism 40. Spring mechanisms 40 are described in more detail in FIG. 3.

Air cylinder 34 is fixed into position above the conveyor 20 by support structure 42. The cylinder 34 and cross arm 30 are positioned in a vertical plane passing approximately through the plane of motion of the cutting blades 26. Support structure 42 preferably supports a cage (not shown) or other protective mechanism to prevent access to the cutting blades 26 while the system is in operation. The cage can be removed for access when necessary.

A photoelectric eye 44 is mounted above the second conveyor 16 on a support arm 46. Support arm 46 is movably attached to positioning support 48. The support arm 46 and positioning support 48 can be connected by a wing nut and bolt assembly 50 or similar connecting means. This allows the support arm 46 to be moved relative to the positioning support 48 and second conveyor 16.

Controller 52 is connected to the photoelectric eye 44. Passage of a meat patty 12 underneath the photoelectric eye 44 causes an indicator of such event to be sent to the controller 52. The controller 52 then causes the air cylinder 34 to drive the piston and rod 32, which is normally maintained in the up position shown in FIG. 1, into a down position. The cutting blades 26 descend and cut the paper strips 20 when the cross arm 30 descends with the piston rod 32. After a short delay, which can be set by the controller 52, the piston rod 32 is driven upward, raising the cutting blades 26. The photoelectric eye 44 is positioned appropriately along the conveyor 16 so that the cutting blades 26 descend between meat patties instead of cutting one of them.

Thus, in summary, meat patties 12 are formed as known in the art and placed on a conveyor 14. As they pass from conveyor 14 to conveyor 16, paper strips 20 are unrolled from rolls 18 to a position underneath the patties 12. Photoelectric eye 44 senses the location of the patties, causing the cutting arms 26 to quickly descend and then rise between passage of the patties. This results in each patty 12 resting On its own cut paper sheet 24.

Figure 2:
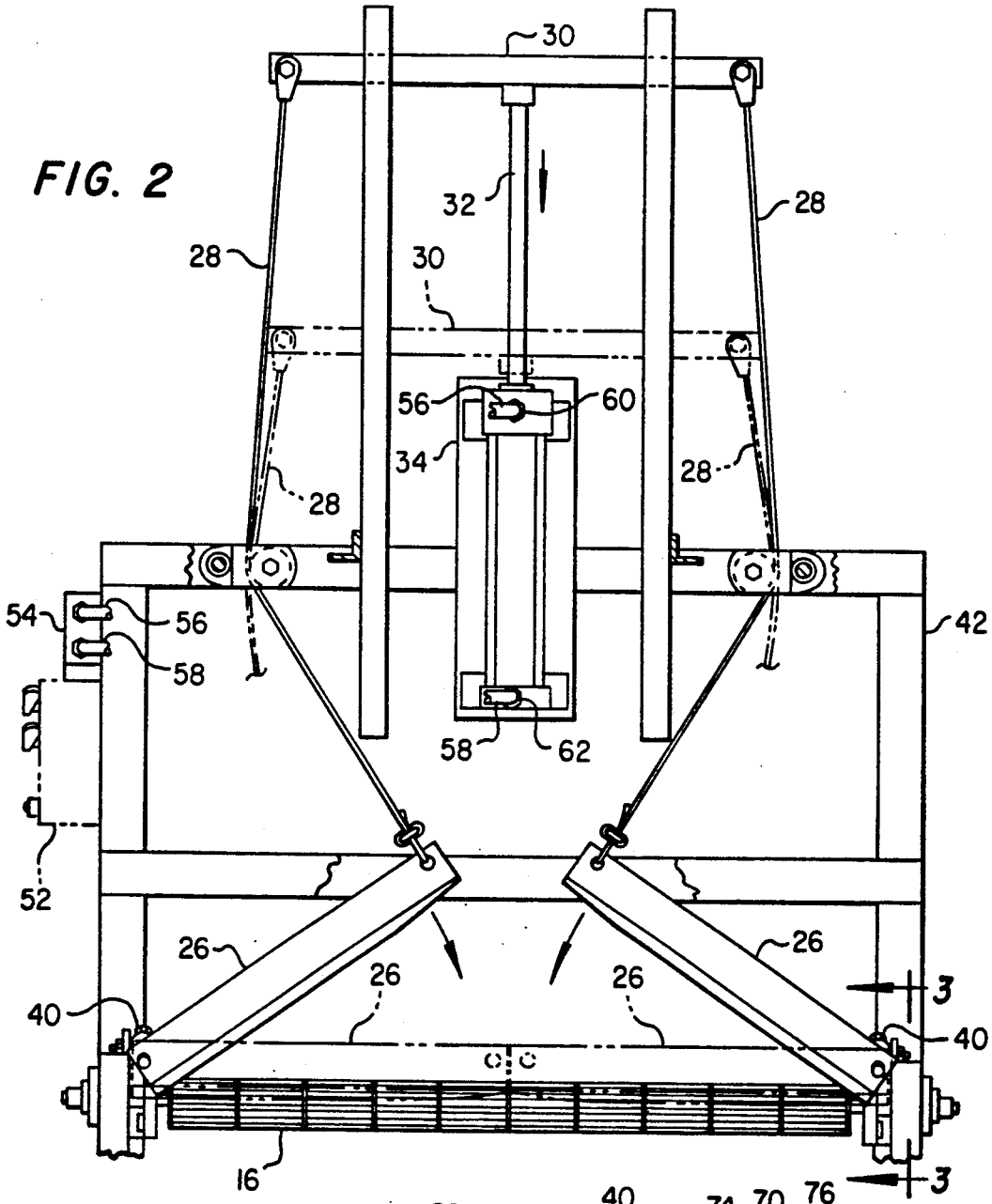
FIG. 2 is an end view of the system of FIG. 1.

FIG. 2 is an end view of conveyor 16 looking from the direction of conveyor 22. The piston rod 32 is shown in its upper position, which is the normal operating position. The cross arm 30, cables 28, and cutting blades 26 are also shown in phantom in their down positions.

Controller 52 controls the position of air valve 54. Air valve 54 is a two position valve connected to a conventional source of compressed air (not shown). Air valve 54 has two output air lines 56, 58. Air line 56 is connected to cylinder 34 through a connector 60. Air line 58 is connected to the cylinder 34 through a connector 62. As long as pressurized air is supplied to the valve 54 one of the air lines 56, 58 is pressurized. Line 58 is normally pressurized, and drives the piston and rod 32 into the upward position. When line 56 is pressurized, the piston and rod 32 are driven into the downward position shown in phantom.

When the piston is driven into the downward position, the cutting blades 26 are allowed to fall and cut the paper beneath them. The blades 26 are fairly heavy, and are spring loaded so that they will fall rapidly. The cables 28 are used only to pull the cutting blades 26 upward; they do not add any downward force when the piston rod 32 is driven to the down position.

The valve 54 is driven by the controller 52 to switch states so as to apply pressure to line 56. The specific design of the system will determine the time delay before line 58 is again repressurized. In a system constructed substantially as shown in FIG. 2, a time delay of approximately 0.6 to 0.8 seconds has proven sufficient for proper operation.

Figure 3:
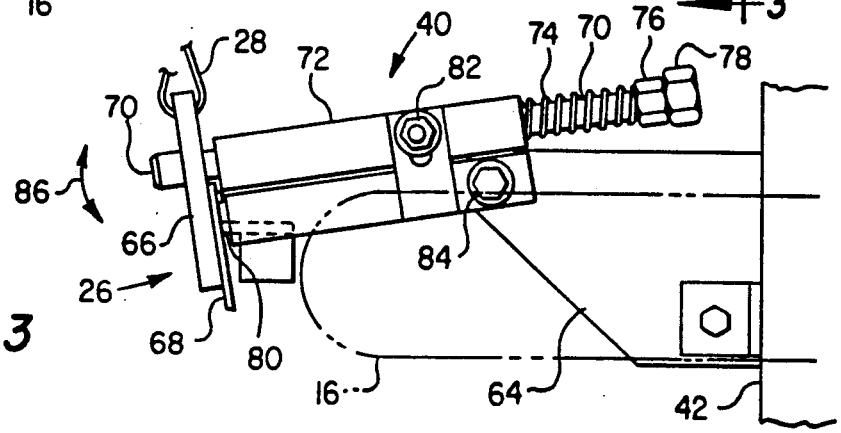
FIG. 3 is a detailed view of a portion of the cutting mechanism.

FIG. 3 illustrates detail of the preferred spring mechanism 40 attached to one end of each cutting blade 26. Spring mechanism 40 is connected to the support structure 42 by a support flange 64. Cutting blade 26 has a body portion 66 and a cutting edge 68. The body portion 66 is connected to the spring mechanism 40 through an axle 70 which extends through a housing 72. A torsion spring 74 provides a torque force on the axle 70, with the amount of force being controlled by adjusting hex nuts 76 and 78.

Cutting of the paper is performed by a shearing action of cutting edge 68 against a fixed cutting edge 80. Cutting edge is attached to the support structure 42 and remains solidly fixed in relation to the support structure 42 and the conveyor belt 16. The angle at which the cutting blade 26 contacts the cutting edge 80 can be adjusted by use of the adjusting screws 82 and 84. The entire spring mechanism 40 can be rotated in the plane of the drawing in the direction shown by arrow 86. In addition, the mechanism 40 can be rotated about a vertical line through screw 82, so that nut 78 moves into and out of the plane of the drawing. These two adjustments allow the shearing action of the cutting edge 68 against the fixed edge 80 to be adjusted until a clean cut of the paper is assured with a minimum amount of binding.

Figure 4:
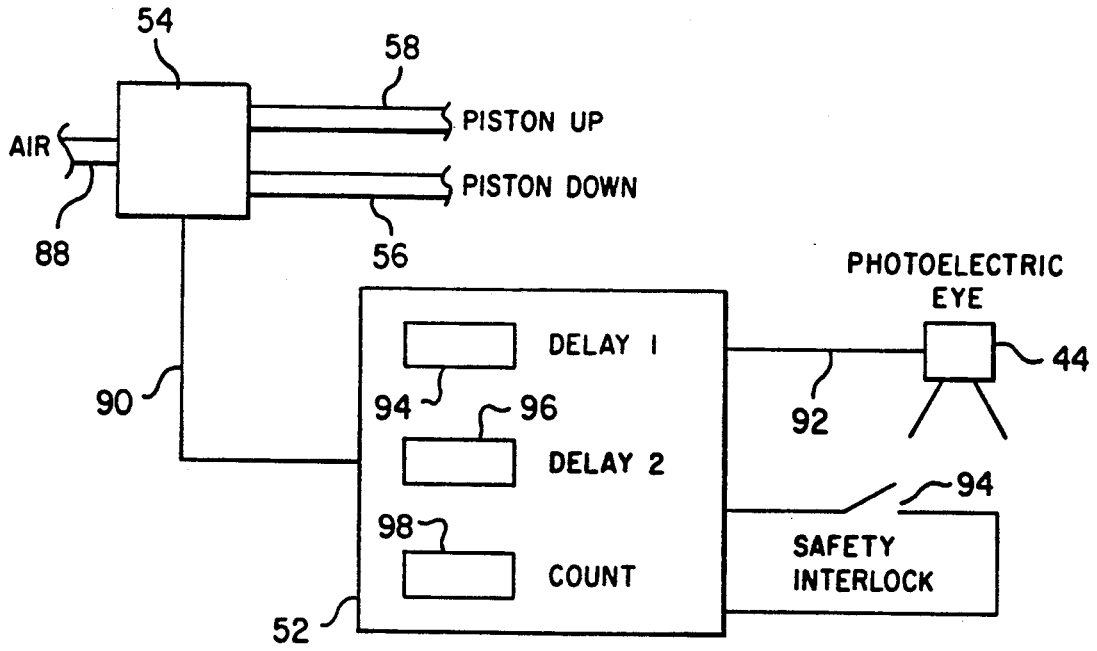
FIG. 4 is a block diagram of a control circuit suitable for use with the system of FIG. 1.

Referring to FIG. 4, a block diagram illustrates a preferred control circuit for the system described above. Air is provided through a pressurized air line 88 to the air valve 54. The air valve 54 causes the compressed air to be redirected to one or the other of the air lines 56 and 58. As described above, pressurizing line 56 causes the piston and piston rod 32 to be driven into the down position, and pressurizing air line 58 drives the piston upward. These up and down positions correspond to the up and down positions of the cutting blades 26.

The air valve 54 is connected to the controller 52 through a signal line 90. This can be a single line which selects one of the two positions of valve 54. Controller 52 is connected to the photoelectric eye 44 through signal line 92. The photoelectric eye 44 is any commercially available device as known in the art, such as a unit combining an RSBR model head with an RBPR model block assembly, both available from Banner Engineering Corporation.

The meat patties are relatively dark compared to the white paper on which they are preferably placed. Thus, when a meat patty passes underneath the photoelectric eye 44, such event is detected and a signal is transferred along line 92 to the controller 52. This signal is connected to the controller 52 so as to initiate a sequence of events. These events control the lowering and raising of the cutting blades 26.

The programmable controller 52 can be any of a number of commercially available controllers, such as a Micro-Wiz Multi-Function Counter, model MWB116B by Electronics Converter Control, Incorporated. Such controllers preferably have at least three programmable parameters. These are a first delay parameter 94, a second delay parameter 96, and a count parameter 98. When the signal on line 92 indicates the occurrence of an event detected by the photoelectric eye 44, the signal line 90 is not changed to reposition the air valve 52 until after the expiration of a time delay stored in first delay parameter 94. The second delay parameter 96 determines a delay period which expires before the signal line on line 90 is changed back to its original state.

This controller function causes operation of the system to occur in the following manner. When the photoelectric eye detects the passage of the leading edge of a meat patty underneath it, a signal is sent to the controller 52 on line 92. Nothing happens for a first delay period defined by the first delay parameter 94. The air valve 54 is switched at the expiration of the first delay period to cause the cutting blades 26 to descend and cut the paper strips 20. At the expiration of the second delay period, defined by the second delay parameter 96, the air valve 54 is switched again to cause the piston 32 and blades 26 to again rise. As described above, the second delay period 96 can be set to be approximately 0.6 to 0.8 seconds, although the best delay time will depend on the spacing of a particular system. The first delay period can be adjusted so that the blades descend between meat patties instead of cutting one of them. If desired, the first delay period can be set to a fixed value such as zero and the adjustment of the cut location with respect to the meat patties on the uncut paper strips 20 can be adjusted by repositioning the electric eye 44 horizontally along the positioning support 48.

A count parameter 98 is used to select the number of patties 12 which pass underneath the photoelectric eye 44 between each cut. If each patty is to be placed on its own sheet of paper, the count parameter 98 will be set to 1. If it is desired, for example, to have two patties on each sheet of paper, the count parameter 98 can be set to two. This will cause the air valve 54 to be switched only after every second meat patty passes underneath the electric eye 44. If a controller is used which does not have a count parameter 98, the blades will always descend for each row of patties which pass under the electric eye 44.

As is the case with most industrial machinery, it is desirable to provide one or more safety interlock switches 94 connected to the controller 52. These are provided for safety reasons. When the protective cage (not shown) described in connection with FIG. 1 is raised, permitting access to the cutting blades 26, the controller 52 is locked out from allowing the cutting blades 26 to descend. Any type of limit switch or other interlock mechanism can be used as known in the art. Other safety features known in the art, such as detectors for jammed or otherwise non-functional machinery, can also be used.

As shown in FIG. 1, the paper rolls 18 have a width approximately equal to one meat patty. If it is desired to pack the patties in sheets having a larger number of patties, for example four patties in a 2 × 2 square, or 16 patties in a 4 × 4 square, wider rolls of paper 18 can be used. Combining use of these wider rolls with setting the count parameter 98 to the desired value results in these and any other desired configuration for placing meat patties onto the cut sheets of paper.

It will be appreciated that, since the conveyor 16 moves continuously, while the blades 26 are descending and cutting the paper strips 20 will tend to pile up against the upstream side of the blades 26 to some extent. However, the paper 20 is flexible and the time during which the blades 26 block forward progress of the paper 20 and patties 12 is short. Thus, it is not necessary to start and stop the conveyor 16 in order to cut the uncut paper strips 20.

While the invention has been particularly shown and described with reference to a preferred embodiment, it will be understood by those skilled in the art that various changes in form and detail may be made therein without departing from the spirit and scope of the invention.

What is claimed is:

1. An apparatus for use in processing food products, comprising:

a conveyor having a first end and a second end, wherein food products are conveyed from the first end to the second end;

at least one roll of flexible material, said roll having a free end and being mounted so that food products resting on the free end on said conveyor cause the flexible material to unroll as the food products are conveyed;

a cutting mechanism positioned at the second conveyor end for cutting the flexible material; and a controller coupled to said cutting mechanism, wherein said controller senses positions of food products on the conveyor and controls said cutting mechanism to cut the flexible material between the food products while said conveyor continues to move.

2. The apparatus of claim 1, wherein said controller comprises:

a sensor for sensing the positions of the food products on said conveyor; and control circuitry connected to said sensor and to said cutting mechanisms for providing a control signal to said cutting mechanism based on the sensed positions of food products, wherein provision of such control signal causes said cutting mechanism to cut the flexible material.

3. The apparatus of claim 2, wherein said sensor comprises a photoelectric eye.

4. The apparatus of claim 2, wherein said control circuitry comprises:

means for generating a first delay period, wherein receipt of a sensing event from said sensor initiates the first delay period;

means for generating a second delay period, wherein the second delay period is initiated at the expiration of the first delay period; and means for providing the control signal only during the second delay period.

5. The apparatus of claim 5, further comprising:

a counter connected to said first delay period generating means for causing the first delay period to be initiated only after a selected number of sensing events.

6. The apparatus of claim 1, wherein said cutting mechanism comprises:

a fixed edge adjacent the second conveyor end and perpendicular to the movement of food products thereon;

at least one cutting blade having first and second ends, the first end being pivotally mounted at a location adjacent the edge, the second end supported by a supporting cable;

a cylinder having a piston and piston rod which can be moved in a vertical direction;

a cross arm connected to the piston rod and the supporting cable, wherein said cutting blade is lifted above said fixed edge when the piston rod is raised, and wherein said cutting blade falls and provides a shearing action against said fixed edge when the piston rod is lowered; and a control valve connected to said cylinder for raising and lowering the piston and piston rod in response to a signal received from said controller.

7. The apparatus of claim 6, wherein the pivotal mounting for the cutting blade first end includes a spring means for biasing said cutting blade against said fixed edge.

8. The apparatus of claim 7, wherein the spring means includes means for adjusting a cutting angle of said cutting blade relative to said fixed edge.

9. The apparatus of claim 1, wherein the flexible material has a flexibility suitable for use with meat patties.

10. The apparatus of claim 1, wherein the flexible material comprises paper.

11. The apparatus of claim 1, wherein said at least one roll of flexible material comprises at least two rolls mounted side by side.

12. The apparatus of claim 1, further comprising:

a second conveyor positioned adjacent the first conveyor end, wherein the flexible material free end passes between the first conveyor end and said second conveyor, and wherein food products moving from said second conveyor onto said first end are positioned on the flexible material free end.

13. A method for processing food products, comprising the steps of:

placing the food products on a paper strip on a continuously moving conveyor;

allowing the paper strip to unroll from a roll as the weight of the food products pressing the paper strip against the conveyor pulls the paper strip in accordance with the motion of the conveyor;

sensing locations of the food products on the conveyor; and cutting the paper strip between food products resting thereon in response to said sensing step while the conveyor continues its movement.

14. The method of claim 11, wherein said cutting step comprises the steps of:

allowing cutting blades to fall and shear the paper strip against a fixed edge;

waiting for a first time delay period; and raising the cutting blades.

15. The method of claim 14, further comprising the step of:

after an object location is sensed, waiting for a second time delay period before allowing the cutting blades to fall.

16. The method of claim 15, further comprising the steps of:

counting food products as they pass a sensing location; and inhibiting the fall of the cutting blades until a preselected number of food products have passed the sensing location.

17. The method of claim 13, wherein the food products comprise meat patties.

* * * * *